US009896632B2

(12) United States Patent
Janssen et al.

(10) Patent No.: US 9,896,632 B2
(45) Date of Patent: Feb. 20, 2018

(54) PROCESS FOR THE CONVERSION OF A PARAFFINIC FEEDSTOCK

(71) Applicant: SHELL OIL COMPANY, Houston, TX (US)

(72) Inventors: Andries Hendrik Janssen, Amsterdam (NL); Eduard Philip Kieffer, Amsterdam (NL); Olav Sammelius, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/032,837

(22) PCT Filed: Oct. 30, 2014

(86) PCT No.: PCT/EP2014/073333
§ 371 (c)(1),
(2) Date: Apr. 28, 2016

(87) PCT Pub. No.: WO2015/063213
PCT Pub. Date: May 7, 2015

(65) Prior Publication Data

US 2016/0251583 A1 Sep. 1, 2016

(30) Foreign Application Priority Data

Oct. 31, 2013 (EP) ..... 13191197

(51) Int. Cl.

| | |
|---|---|
| ***C10G 69/02*** | (2006.01) |
| ***C10G 45/64*** | (2006.01) |
| ***C10G 65/12*** | (2006.01) |
| ***C10G 2/00*** | (2006.01) |
| ***C10G 67/02*** | (2006.01) |

(52) U.S. Cl.
CPC ..... *C10G 69/02* (2013.01); *C10G 2/30* (2013.01); *C10G 45/64* (2013.01); *C10G 65/12* (2013.01); *C10G 67/02* (2013.01); *C10G 2300/1022* (2013.01)

(58) Field of Classification Search
CPC .. C10G 2300/1022; C10G 2/30; C10G 45/64; C10G 65/12; C10G 67/02; C10G 69/02; C07C 5/02; C07C 5/13; C07C 5/22
See application file for complete search history.

(56) References Cited

U.S. PATENT DOCUMENTS

| | | | | |
|---|---|---|---|---|
| 4,343,692 | A | 8/1982 | Winquist | |
| 4,574,043 | A | 3/1986 | Chester et al. | |
| 4,859,311 | A | 8/1989 | Miller | |
| 5,053,373 | A | 10/1991 | Zones | |
| 5,157,191 | A | 10/1992 | Bowes et al. | |
| 5,252,527 | A | 10/1993 | Zones | |
| 2004/0077505 | A1 | 4/2004 | Danie et al. | |
| 2004/0256286 | A1* | 12/2004 | Miller | C10G 65/12 208/58 |
| 2011/0124940 | A1 | 5/2011 | Burton, Jr. | |

FOREIGN PATENT DOCUMENTS

| | | |
|---|---|---|
| EP | 532118 | 5/1989 |
| EP | 832171 | 12/1996 |
| EP | 776959 | 6/1997 |
| EP | 666894 | 11/2000 |
| WO | 1997018278 | 5/1997 |
| WO | 2000014179 | 3/2000 |
| WO | 2000029511 | 5/2000 |
| WO | 2002076027 | 9/2002 |
| WO | 2009080681 | 7/2009 |
| WO | 2012055755 | 5/2012 |
| WO | 2012055759 | 5/2012 |
| WO | 2013127592 | 9/2013 |

* cited by examiner

*Primary Examiner* — Sharon Pregler

(57) ABSTRACT

The disclosure relates to the conversion of a paraffinic feedstock that comprises at least 50 wt % of compounds boiling above 370° c. and which has a paraffin content of at least 60 wt %, an aromatics content of below 1 wt %, a naphthenic content below 2 wt %, a nitrogen content of below 0.1 wt % The process includes:

a) subjecting the paraffinic feedstock to a hydroprocessing step to obtain an at least partially isomerized feedstock; and b) separating the at least partially isomerized feedstock into one or more middle distillate fractions and a first residual fraction. Step (a) is carried out by contacting the paraffinic feedstock with a first catalyst having hydrocracking and hydroisomerizing activity and then with a second catalyst having hydrocracking and hydroisomerizing activity. The second catalyst is more active in hydroisomerization and less active in hydrocracking than the first catalyst.

13 Claims, No Drawings

PROCESS FOR THE CONVERSION OF A PARAFFINIC FEEDSTOCK

PRIORITY CLAIM

The present application is the National Stage (§ 371) of International Application No. PCT/EP2014/073333, filed Oct. 30, 2014, which claims priority from European Application No. 13191197.6, filed Oct. 31, 2013, incorporated herein by reference.

FIELD OF THE INVENTION

The invention relates to a process for the conversion of a paraffinic feedstock, in particular for the conversion of a paraffinic feedstock derived from a Fischer-Tropsch synthesis process.

BACKGROUND TO THE INVENTION

It is known to prepare one or more middle distillate fractions such as for example kerosene or gasoil and a base oil precursor or a base oil from a Fischer-Tropsch derived feedstock.

In WO02/076027 for example, is disclosed a process wherein two or more lubricating base oil grades and a gas oil are obtained by hydrocracking/hydroisomerising a C5+ Fisher-Tropsch product over a catalyst comprising platinum supported on a silica-alumina carrier prepared from amorphous silica-alumina and separating the product thus obtained in one or more gasoil fractions and a base oil precursor fraction. After performing a pour point reducing step, for example catalytic dewaxing, to the base oil precursor fraction, the base oil precursor fraction is separated into two or more base oil grades.

In WO2009/080681 is disclosed a process to prepare a gas oil and a base oil from a Fischer-Tropsch derived feedstock, wherein the feedstock is subjected to a hydroprocessing step to obtain an isomerised feedstock, separating the isomerised feedstock by means of distillation into at least a gas oil fraction, a heavy distillate fraction and a residual fraction, recycling at least part of the heavy distillate fraction to the hydroprocessing step and reducing the pour point of the residual fraction by means of catalytic dewaxing to obtain the base oil.

There is, however, still a need for improvement of middle distillate products and base oils from paraffinic feedstocks, such as Fischer-Tropsch derived feedstocks, in particular with respect to the cold flow properties of the base oil and/or middle distillate products.

SUMMARY OF THE INVENTION

It has now been found that by using two different catalysts in series in the hydrocracking/hydroisomerising of a paraffinic feedstock, in particular a Fischer-Tropsch derived feedstock, wherein both catalysts have hydrocracking and hydroisomerising activity and the second catalyst is more active in hydroisomerisation and less active in hydrocracking compared to the first catalyst, a product is obtained from which lubricating base oils with improved cold flow properties can be prepared. Moreover, one or more middle distillate fractions with improved yield and/or cold flow properties can be obtained.

Accordingly, the present invention relates to a process for the conversion of a paraffinic feedstock that comprises at least 50 wt % of compounds boiling above 370° C. and which has a paraffin content of at least 60 wt %, an aromatics content of below 1 wt %, a naphthenic content below 2 wt %, a nitrogen content of below 0.1 wt %, and a sulphur content of below 0.1 wt %, the process comprising:

a) subjecting the paraffinic feedstock to a hydroprocessing step to obtain an at least partially isomerised feedstock;

b) separating the at least partially isomerised feedstock into one or more middle distillate fractions and a first residual fraction, wherein step a) is carried out by contacting the paraffinic feedstock with a first catalyst having hydrocracking and hydroisomerising activity and then with a second catalyst having hydrocracking and hydroisomerising activity, wherein the second catalyst is more active in hydroisomerisation and less active in hydrocracking than the first catalyst.

DETAILED DESCRIPTION OF THE INVENTION

In the process according to the invention, a paraffinic feedstock comprising at least 50 wt % of compounds boiling above 370° C. and having a paraffin content of at least 60 wt %, an aromatics content of below 1 wt %, a naphthenic content below 2 wt %, a nitrogen content of below 0.1 wt %, and a sulphur content of below 0.1 wt %, is subjected to a hydroprocessing step to obtain an at least partially isomerised feedstock (step a). The at least partially isomerised feedstock obtained in step a) is separated into at least one middle distillate fraction and a residual fraction in step b).

Hydroprocessing step a) is carried out by contacting the paraffinic feedstock first with a first catalyst having hydrocracking and hydroisomerising activity and then with a second catalyst having hydrocracking and hydroisomerising activity. The second catalyst is more active in hydroisomerisation and less active in hydrocracking than the first catalyst. Reference herein to a catalyst having more or less activity in hydroisomerisation or hydrocracking is to a catalyst having more or less of such activity for the same feedstock determined under comparable conditions, i.e. compared at the same temperature, pressure, space velocity and hydrogen partial pressure. An example of conditions to establish the activity is the conditions of the examples.

The subsequent contacting with the first and second catalysts may be carried out in a configuration with two reactors in series, i.e. with the first catalyst in a first reactor and the second catalyst in a second reactor. Preferably, step a) is carried out in a reactor comprising the first catalyst above the second catalyst in a stacked bed configuration.

Preferably, the ratio of volume of the first catalyst and volume of the second catalyst is at least 1.0, more preferably in the range of from 1.0 to 20, even more preferably in the range of from 1.5 to 10, still more preferably in the range of from 2.0 to 8.0. Reference herein to volume of a catalyst is to the volume of a fixed configuration wherein such catalyst is arranged, typically the volume of a catalyst bed.

Preferably, the process further comprises step c) wherein at least part of the first residual fraction is subjected to vacuum distillation to obtain a distillate base oil fraction and a second residual fraction. The second residual fraction thus obtained is preferably recycled to step a).

The distillate base oil fraction is preferably subjected to a catalytic dewaxing step d) to obtain a dewaxed base oil fraction.

It has been found that the process according to the invention results in a first residual fraction from which one or more lubricating base oils with significantly improved cold flow properties can be obtained, preferably after vacuum distillation and catalytic dewaxing of the distillate base oil fraction obtained in vacuum distillation step c). Compared to the cold flow properties of base oils obtained in a process wherein a single catalyst is used in hydroconversion step a), a distillate base oil fraction with significantly improved cold flow properties is obtained. Moreover, middle distillate fractions, in particular kerosene and gasoil, with improved cold flow properties are obtained.

The feedstock used in the present invention is a paraffinic feedstock that comprises at least 50 wt % of compounds boiling above 370° C. and which has a paraffin content of at least 60 wt %, an aromatics content of below 1 wt %, a naphthenic content of below 2 wt %, a nitrogen content of below 0.1 wt %, and a sulphur content of below 0.1 wt %.

Preferably, the paraffinic feedstock is derived from a Fischer-Tropsch process, i.e. from a paraffinic stream synthesised in a Fischer-Tropsch hydrocarbon synthesis process wherein synthesis gas is fed into a reactor where the synthesis gas is converted at elevated temperature and pressure to paraffinic compounds. Fischer-Tropsch hydrocarbon synthesis processes are well-known in the art. The feedstock may for example be obtained by separating from a Fischer-Tropsch synthesis product part or all of the paraffin fraction boiling above 370° C. In another embodiment the feedstock is obtained by separating from a Fischer-Tropsch synthesis product part or all of the paraffin fraction boiling above 540° C. In yet another embodiment the feedstock is obtained by combining a Fischer-Tropsch synthesis product with a Fischer-Tropsch derived fraction comprising compounds boiling above 540° C.

The feedstocks described above may be subjected to a hydrogenation step before being sent to hydroprocessing step a) of the process according to the invention.

Preferably, the feedstock comprises at least 60 wt % compounds boiling above 370° C., more preferably at least 70 wt %.

In one embodiment, the feedstock has a substantial amount of components boiling above 540° C. The weight ratio of compounds boiling above 540° C. and compounds boiling between 370 and 540° C. in the feedstock is preferably at least 0.1:1, more preferably at least 0.3:1, even more preferably at least 0.5:1.

The feedstock has a paraffin content of at least 60 wt %, preferably at least 70 wt %, more preferably at least 80 wt %.

The feedstock may contain up to 40 wt % of olefins, oxygenates or combinations thereof, preferably up to 30 wt %, more preferably up to 20 wt %.

The feedstock has an aromatics content of less than 1 wt %, preferably less than 0.5 wt %, even more preferably less than 0.1 wt %. The feedstock has a naphthenic content of less than 2 wt %, preferably less than 1 wt %.

The feedstock has a sulphur content of less than 0.1 wt %, preferably less than 0.01 wt %, more preferably less than 0.001 wt %.%. The feedstock has a nitrogen content of less than 0.1 wt %, preferably less than 0.01 wt %, more preferably less than 0.001 wt %.

In the process according to the invention, the feedstock is subjected to hydroprocessing step a) to obtain an at least partially isomerised feedstock. In step a), the feedstock is contacted in the presence of hydrogen, typically at a temperature in the range of 175 to 400° C. and a pressure in the range of 20 to 100 bar (absolute), with the first catalyst and then with the second catalyst. The feedstock will undergo combined hydrocracking, hydrogenation and hydroisomerisation in step a).

The temperature in hydroprocessing step a) will inter alia depend on the nature of the feedstock, the nature of the catalysts, the pressure applied, the feed flow rate and the conversion aimed for. Preferably, the temperature is in the range of from 250 to 375° C.

The pressure applied in step a) will depend on the nature of the feedstock, the hydrogen partial pressure, the nature of the catalyst, the product properties aimed for and the conversion aimed for. The pressure is preferably in the range of from 20 to 80 bar (absolute), more preferably in the range of 30 to 80 bar (absolute). Reference herein to the pressure is to the total pressure at the exit of the reactor.

Hydrogen may be supplied to step a) at a gas hourly space velocity of from 100 to 10,000 normal liters (NL) per liter catalyst per hour, preferably of from 500 to 5,000 NL/L·hr. The feedstock may be provided at a weight hourly space velocity of from 0.1 to 5.0 kg per liter catalyst per hour, preferably of from 0.5 to 2.0 kg/L·hr.

The ratio of hydrogen to feedstock may range of from 100 to 5,000 NL/kg and is preferably of from 250 to 2,500 NL/kg. Reference herein to normal liters is to liters at conditions of standard temperature and pressure, i.e. at 0° C. and 1 atmosphere.

Hydrogen may be provided as pure hydrogen, or in the form of a hydrogen-containing gas, typically containing more than 50 vol. % of hydrogen, preferably containing more than 60 vol. % of hydrogen. Suitable hydrogen-containing gases include those from a catalytic reforming, partial oxidation, catalytic partical oxidation, autothermal reforming or any other hydrogen production process, possibly followed by a (catalytic) hydrogen enrichment and/or purification step. Suitably, product gas rich in molecular hydrogen from step a), may be recycled to step a).

In case step a) is carried out in different reactors, i.e. a first reactor with the first catalyst and a second reactor with the second catalyst, different reaction conditions may be applied in the different reactors, which increases the flexibility to adapt process conditions to variations in for example feedstock, desired products and catalysts. Preferably, both reactors are operated at the same pressure.

If step a) is carried out in a single reactor, the temperatures at which both catalysts are operated are preferably similar, i.e. deviating not more than 20° C. from each other.

In step b) of the process according to the invention, the at least partially isomerised feedstock is separated into one or more middle distillate fractions and a first residual fraction. Step b) typically is a fractionation step, preferably an atmospheric distillation step.

The one or more middle distillate fractions may comprise a single middle distillate fraction, for example a single fraction having a majority of components, for instance 95 vol % or greater, boiling in the range of from 150° C. to 400° C. Alternatively, two or more middle distillate fractions are obtained, preferably at least a gasoil fraction is obtained, more preferably a kerosene fraction and gas oil fraction are obtained. The gas oil fraction will usually contain a majority of components having boiling points within the typical diesel fuel ("gas oil") range, i.e. from about 150 to 400° C. or from 170 to 370° C. It will suitably have a 90 vol % distillation temperature of from 300 to 370° C. The gas oil fraction will suitably have a flash point (ASTM D-92) of 100° C. or higher, preferably 110° C. or higher, for example in the range of from 110 to 120° C.

In case the one or more middle distillate fractions obtained in step b) are to be applied in applications wherein cold flow properties are important, the one or more middle distillate fractions may be subjected to a catalytic dewaxing step.

The first residual fraction comprises compounds boiling above the middle distillate boiling range. Preferably, at least part of the first residual fraction is subjected in step c) to vacuum distillation to obtain a distillate base oil fraction and a second residual fraction. The second residual fraction thus obtained typically comprises compounds boiling above a temperature in the range of from 450 to 550° C. Preferably, at least part of the second residual fraction is recycled to step a). In case of recycling of the second residual fraction or of another fraction obtained in fractionation of the hydroprocessed feedstock, reference herein to the feedstock to step a) is to the combined feedstock, i.e. to the total of fresh feedstock and any recycled fraction.

The distillate base oil fraction obtained in step c) will have an intermediate boiling range. Such a fraction preferably has a T90 wt % boiling point of between 400 and 550° C., preferably between 450 and 550° C.

The distillate base oil fraction is preferably subjected to a catalytic dewaxing step d) to obtain a dewaxed base oil fraction. In catalytic dewaxing step d), the pour point of the distillate base oil fraction is reduced by hydroisomerising the fraction in the presence of a dewaxing catalyst. The dewaxed base oil fraction may be further subjected to a hydrogenation step and/or a distillation step to obtain more than one base oil fractions.

Any suitable dewaxing catalyst may be used in step d). Such catalysts include heterogeneous catalysts comprising a molecular sieve, preferably in combination with a metal having a hydrogenation function, such as a Group VIII metal. Molecular sieves, and more suitably intermediate pore size zeolites, have shown a good catalytic ability to reduce the pour point of distillate base oil fractions under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-12, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 4,343,692, U.S. Pat. No. 5,053,373, U.S. Pat. No. 5,252,527 and U.S. Pat. No. 4,574,043.

The dewaxing catalyst suitably also comprises a binder. The binder can be a synthetic or naturally occurring (inorganic) substance, for example clay, silica and/or metal oxides. Natural occurring clays are for example the montmorillonite and kaolin families. The binder is preferably a porous binder material, for example a refractory oxide, such as for example alumina, silica-alumina, silica-magnesia, silica-zirconia, silica-thoria, silica-beryllia, silica-titania, or ternary compositions such as silica-alumina-thoria, silica-alumina-zirconia, silica-alumina-magnesia and silica-magnesia-zirconia. More preferably, a low acidity refractory oxide binder material, which is essentially free of alumina, is used. Examples of these binder materials are silica, zirconia, titanium dioxide, germanium dioxide, boria and mixtures of two or more thereof. A particularly preferred binder is silica.

Preferably, the dewaxing catalyst comprises intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171.

Particularly preferred dewaxing catalysts are catalysts containing zeolite ZSM-48 and/or EU-2 and more specifically those further containing titania as binder. The zeolite preferably has a molar bulk ratio of silica to alumina of greater than 100:1. Specific preferred catalysts are described in WO 2012/055759 and WO 2012/055755. Most preferred are the catalysts described in WO 2013/127592.

More preferably the molecular sieve is a MTW, MTT or TON type molecular sieve or ZSM-48, of which examples are described above, the Group VIII metal is platinum or palladium and the binder is silica.

Preferably, the catalytic dewaxing of the distillate base oil fraction is performed in the presence of a catalyst as described above wherein the zeolite has at least one channel with pores formed by 12-member rings containing 12 oxygen atoms. Preferred zeolites having 12-member rings are of the MOR type, MTW type, FAU type, or of the BEA type (according to the framework type code). Preferably a MTW type, for example ZSM-12, zeolite is used. A preferred MTW type zeolite containing catalyst also comprises platinum or palladium metal as Group VIII metal and a silica binder. More preferably the catalyst is a silica-bound, ammonium hexafluorosilicate-treated Pt/ZSM-12 containing catalyst as described above. These 12-member ring type zeolite based catalysts are preferred because they have been found to be suitable to convert waxy paraffinic compounds to less waxy iso-paraffinic compounds.

Catalytic dewaxing conditions are known in the art and typically involve operating temperatures in the range of from 200 to 500° C., suitably of from 250 to 400° C., hydrogen pressures in the range of from 10 to 200 bar, preferably of from 40 to 70 bar, weight hourly space velocities (WHSV) in the range of from 0.1 to 10 kg of oil per liter of catalyst per hour (kg/l/hr), suitably of from 0.2 to 5 kg/l/hr, more suitably of from 0.5 to 3 kg/l/hr and hydrogen to oil ratios in the range of from 100 to 2,000 liters of hydrogen per liter of oil.

The first catalyst in hydroprocessing step a) preferably comprises a Group VIII noble metal supported on an amorphous acidic carrier. Reference herein to an amorphous carrier is to a carrier not comprising a zeolitic or otherwise crystalline material. Preferred amorphous acidic carriers comprise refractory metal oxide carriers, more preferably silica, alumina, silica-alumina, zirconia, titania and mixtures thereof, even more preferably silica, alumina and silica-alumina. A particularly preferred first catalyst comprises platinum supported on a silica-alumina carrier. If desired, applying a halogen moiety, in particular fluorine, or a phosphorous moiety to the carrier, may enhance the acidity of the catalyst carrier.

The first catalyst preferably comprises a Group VIII noble metal as hydrogenation/dehydrogenation functionality. The Group VIII noble metal preferably is palladium, platinum or a combination thereof, more preferably platinum. The first catalyst may comprise the Group VIII noble metal in an amount of from 0.005 to 5 parts by weight, preferably from 0.02 to 2 parts by weight, per 100 parts by weight of carrier material. A particularly preferred first catalyst comprises platinum in an amount in the range of from 0.05 to 2 parts by weight, more preferably from 0.1 to 1 parts by weight, per 100 parts by weight of carrier material. The first catalyst may also comprise a binder to enhance the strength of the catalyst. The binder can be non-acidic. Examples are clays and other binders known to one skilled in the art. Examples of catalysts that may suitably be used as first catalyst are described in WO-A-0014179, EP-A-532118, EP-A-666894, EP-A-776959, and WO2009/080681.

The second catalyst in hydroprocessing step a) preferably comprises a Group VIII metal and a medium pore size molecular sieve. The second catalyst may for example be any catalyst comprising a Group VIII metal and a medium pore size molecular sieve as described hereinbefore for catalytic dewaxing step d). Preferably, the medium pore size molecular sieve of the second catalyst is a MTW, MTT, TON type molecular sieve or ZSM-48, more preferably a MTW molecular sieve. The Group VIII metal of the second catalyst preferably is platinum, palladium or a combination thereof. A second catalyst comprising a MTW molecular sieve, platinum or palladium as Group VIII metal and a silica binder is particularly preferred. A particularly preferred second catalyst is a silica-bound, ammonium hexafluorosilicate-treated Pt/ZSM-12 containing catalyst as described hereinabove.

In case hydroprocessing step a) is carried out in two reactors in series, i.e. a first reactor containing the first catalyst and a second reactor containing the second catalyst, the entire hydroprocessed feedstock obtained in the first reactor is supplied to the second reactor to be contacted with the second catalyst.

The invention is illustrated by the following non-limiting examples.

EXAMPLES

Example 1 (According to the Invention)

A paraffinic feedstock derived from a Fischer-Tropsch hydrocarbon synthesis process, was supplied to a hydroprocessing reactor comprising a stacked bed of a first catalyst above a second catalyst. The volume ratio of first catalyst to second catalyst in the reactor was 4:1.

The feedstock comprised 78 wt % of compounds boiling above 370° C., more than 80 wt % paraffins, less than 1 wt % aromatics, less than 2 wt % naphthenic compounds, less than 0.1 wt % nitrogen and less than 2 ppmw sulphur.

The first catalyst comprised 0.8 wt % platinum on an amorphous silica-alumina carrier.

The second catalyst was a silica-bound, ammonium hexafluorosilicate-treated Pt/ZSM-12 catalyst.

The hydroprocessing reactor was operated at 60 barg and an overall weight hourly space velocity, i.e. based on the total volume of catalyst in the reactor, of 0.81 kg fresh feedstock per liter catalyst per hour.

The effluent of the hydroprocessing reactor was fractionated in an atmospheric distillation step into a gaseous stream (off-gas), a distillate fraction (cut point of about 370° C.), and a first residual fraction. The first residual fraction was subjected to a vacuum distillation step to obtain a distillate base oil fraction (cut point of about 540° C.) and a second residual fraction. The second residual fraction was recycled to the hydroprocessing reactor. The combined feed ratio, i.e. the quotient of the sum of fresh feedstock and recycled second residual fraction and the fresh feedstock, was kept at 1.30. The reaction temperature was adjusted such that the amount of second residual fraction obtained, i.e. the amount of compounds boiling above 540° C., was maintained at 30% of the amount of fresh feedstock.

Example 2 (Comparison)

The experiment of EXAMPLE 1 was repeated, but now with only the first catalyst in the hydroprocessing reactor, in an amount equal to the total amount (volume) of catalyst in EXAMPLE 1.

In the Table, the weighted average bed temperature (WABT) of the different catalytic zones (first or second catalyst) in the hydroprocessing step, the overall weight hourly space velocity (WHSV), the conversion per pass (CPP) of compounds boiling above 370° C. and of compounds boiling above 540° C., the yields and the cold flow properties of the (atmospheric) distillation fraction and of the distillate base oil fraction are given.

TABLE

Yields and cold flow properties

| | Example 1 | Example 2 |
|---|---|---|
| WABT first catalyst (° C.) | 341 | 339 |
| WABT second catalyst (° C.) | 341 | n.a. |
| WHSV (kg/L.hr) | 0.81 | 0.82 |
| CPP >370° C. (wt %) | 47 | 51 |
| CPP >540° C. (wt %) | 64 | 63 |
| Yield (wt % on weight of fresh feed) | | |
| distillate fraction | 67 | 71 |
| distillate base oil fraction | 23 | 17 |
| Cold flow properties | | |
| distillate fraction cloud point (° C.) | −34 | −21 |
| distillate fraction pour point (° C.) | −47 | −42 |
| distillate base oil cloud point (° C.) | +34 | +55 |
| distillate base oil pour point (° C.) | −17 | +48 |

n.a.: not applicable

That which is claimed is:

1. A process for the conversion of a paraffinic feedstock that comprises at least 50 wt % of compounds boiling above 370° C. and which has a paraffin content of at least 60 wt %, an aromatics content of below 1 wt %, a naphthenic content below 2 wt %, a nitrogen content of below 0.1 wt %, and a sulphur content of below 0.1 wt %, the process comprising:

a) subjecting the paraffinic feedstock to a hydroprocessing step to obtain an at least partially isomerised feedstock;

b) separating the at least partially isomerised feedstock into one or more middle distillate fractions and a first residual fraction, wherein step a) is carried out by contacting the paraffinic feedstock with a first catalyst having hydrocracking and hydroisomerising activity and then with a second catalyst having hydrocracking and hydroisomerising activity, wherein the second catalyst is a silica-bound, ammonium hexafluorosilicate-treated Pt/ZSM-12 catalyst which is more active in hydroisomerisation and less active in hydrocracking than the first catalyst.

2. A process according to claim 1, wherein the first catalyst comprises a Group VIII noble metal supported on an amorphous acidic carrier.

3. A process according to claim 1, further comprising:

c) subjecting at least part of the first residual fraction to vacuum distillation to obtain a distillate base oil fraction and a second residual fraction.

4. A process according to claim 3, wherein the second residual fraction is recycled to step a).

5. A process according to claim 3, wherein the process further comprises:

d) subjecting the distillate base oil fraction obtained in step c) to a catalytic dewaxing step to obtain dewaxed base oil fraction.

6. A process according to claim 1, wherein the paraffinic feedstock is derived from a Fischer Tropsch process.

7. A process according to claim 1, wherein step a) is carried out in a reactor comprising the first catalyst above the second catalyst in a stacked bed configuration.

8. A process according to claim 1, wherein the ratio of volume of the first catalyst and volume of the second catalyst is at least 1.0.

9. A process according to claim 8, wherein ratio of volume of the first catalyst and volume of the second catalyst is in the range of from 1.5 to 10.

10. A process according to claim 2, wherein the amorphous acidic carrier of the first catalyst is silica-alumina.

11. A process according to claim 1, wherein the Group VIII noble metal of the first catalyst is platinum.

12. A process according to claim 11 wherein the first catalyst comprises platinum supported on a silica-alumina carrier.

13. A process according to claim 1 wherein step a is performed such that both catalysts are operated at a temperature deviating no more than 20° C. from each other.

* * * * *